US006578301B1

(12) United States Patent
Ericson

(10) Patent No.: US 6,578,301 B1
(45) Date of Patent: Jun. 17, 2003

(54) BI-DIRECTIONAL VISUAL DISPLAY ASSEMBLY

(76) Inventor: Greg Ericson, 914 River Park Dr., Memphis, TN (US) 38103

( * ) Notice: Subject to any disclaimer, the term of this patent is extended or adjusted under 35 U.S.C. 154(b) by 0 days.

(21) Appl. No.: 09/973,008

(22) Filed: Oct. 10, 2001

(51) Int. Cl.[7] ..... G09F 15/00

(52) U.S. Cl. ..... 40/606; 312/234.1; 211/119.005; 40/572

(58) Field of Search ..... 40/572, 609, 606, 40/791, 792; 248/156; 312/234, 234.1; 211/119.005, 119.013

(56) References Cited

U.S. PATENT DOCUMENTS

| | | | | | |
|---|---|---|---|---|---|
| 1,429,211 | A | | 9/1922 | Lightburn | |
| 1,702,692 | A | * | 2/1929 | Henderson | 40/609 X |
| 3,572,045 | A | * | 3/1971 | Owen | 248/156 X |
| 4,125,243 | A | | 11/1978 | Liptak | |
| 4,380,880 | A | * | 4/1983 | Gandy | 40/572 X |
| 4,523,400 | A | * | 6/1985 | Seely | 40/791 |
| 4,586,207 | A | * | 5/1986 | Cornette | 248/156 X |
| 4,773,622 | A | | 9/1988 | Herlin | 40/539 X |
| 5,295,500 | A | | 3/1994 | Leu | |
| 5,397,125 | A | | 3/1995 | Adams | |
| 5,470,038 | A | * | 11/1995 | Clark | 248/156 |
| 5,579,599 | A | | 12/1996 | Haeseler | 40/606 |
| 5,682,696 | A | | 11/1997 | Gill | 40/606 |
| 5,799,767 | A | | 9/1998 | Molbak | |
| 5,813,927 | A | * | 9/1998 | Anglea | 248/156 X |
| 5,815,971 | A | * | 10/1998 | Rothe et al. | 40/792 X |
| 6,015,124 | A | | 1/2000 | Loy | 40/606 |

* cited by examiner

*Primary Examiner*—Joanne Silbermann
(74) *Attorney, Agent, or Firm*—Jacobson Holman PLLC

(57) ABSTRACT

A visual display mounting assembly has first and second vertical metal plate legs and transverse stop plates extending in cantilever manner from opposite sides of the vertical legs at a position spaced above the lower ends of the leg. A visual display support is attached to the upper ends of the legs and includes a pivotal clamp frame for clamping a display sign, poster or other visible sheet in position on each side of the display so that the device can be positioned between rows of vending or gaming machines to provide visible access of the display to users of either row. In a second back-lit embodiment fluorescent rubes are provided between translucent plastic support panels.

14 Claims, 7 Drawing Sheets

BI-DIRECTIONAL VISUAL DISPLAY ASSEMBLY

BACKGROUND OF THE INVENTION

The present invention is in the field of visual display devices and is more specifically directed to a unique visual display of a bi-directional view capability, which can be mounted between the back-facing surfaces of back-to-back rows of gaming or vending machines for encouraging use or providing other messages for customers or users of both rows of such machines. One contemplated usage of the present invention is in connection with back-to-back rows of slot machines; however, usage of the subject invention is not limited to slot machines since the invention has equal applicability for usage with other types of vending machines, including but not limited to, merchandise display cabinets and the like.

The field of signs and display devices is replete with devices providing back-to-back or double-sided displays of information such as exemplified in. U.S. Pat. Nos. 5,579,599 and 5,682,696. Other prior devices such as U.S. Pat. Nos. 1,429,211; 5,295,500 and 5,799,767 are directed to various types of apparatus for attaching a sign to supporting structures such as posts, automobiles and the like. Similarly, the use of signs with gaming devices such as slot machines is well known and is exemplified in U.S. Pat. No. 5,397,125 in which a forwardly-facing sign is provided on fixedly extending vertical pipes attached to the base on which the slot machine rests. However, the prior art is devoid of any teaching of double-sided signs or other display materials which can be easily changed and in which a single sign is visible by users of two back-to-back gaming machines while being easily replaceable without need for mechanical connection or disassembly of any sort.

Therefore, there remains an unmet need for display assemblies or apparatus, which can be easily associated with or removed from association with back-to-back machines such as gaming machines or the like without there being any need for mechanical connection, disconnection or other time consuming and expensive procedures.

Therefore, it is the primary object of the present invention to provide a new and improved display apparatus for mounting on back-to-back gaming or other devices, which can provide messages to persons viewing such devices from the front of either of the devices.

A further object of the present invention is the provision of a new and improved sign assembly, which can be positioned on and supported in stable manner between two rows of devices arranged in back-to-back manner.

Yet another object of the present invention is to provide a new and improved back-lit display apparatus for mounting on back-to-back gaming or other devices, which can provide messages to persons viewing such devices from the front of either of the devices.

An additional object of the present invention is the provision of a new and improved back-lit sign assembly, which can be positioned on and supported in a stable manner between two rows of devices arranged in back-to-back manner.

Yet another object of the present invention is the provision of a new and improved display having leg-type supports resting on the tops of back-to-back devices and including means engaging such devices for providing horizontal stability.

BRIEF SUMMARY OF THE INVENTION

Achievement of the foregoing objects of the invention is enabled by the preferred embodiments of the invention through the provision of a display mounting assembly comprising first and second vertical metal legs having transverse stop plates extending in cantilever manner from opposite sides of each leg. The stop plates are positioned above the lower end of the leg which is extended downwardly into an open space or valley between back-to-back rows of gaming or vending machines. Visual display supports comprising fiber panels, boards or the like are attached to the upper ends of the vertical legs and include clamp frame members defining a rectangular periphery of the display supports and which are openable to receive and clamp posters, signs or the like on outwardly facing surfaces of the assembly so that such signs are visible to users of either row of vending or gaming machines.

An alternative embodiment of the invention comprises a back-lit display mounting assembly in which translucent support panels are provided in place of fiber panels or boards and fluorescent light tubes or other light sources are incorporated between the translucent panels for effecting display of transparency type posters, signs or the like. The back-lit embodiment is identical to the first embodiment with the exception of the fact that the translucent support panels are spaced apart a greater distance than the fiber panels of the first embodiment so as to accommodate positioning of the fluorescent tubes.

Alternative embodiments additionally include rounded corner construction, which can be used with either the first embodiment or the alternative back-lit embodiment if desired.

DETAILED DESCRIPTION OF THE INVENTION

Figure 2:
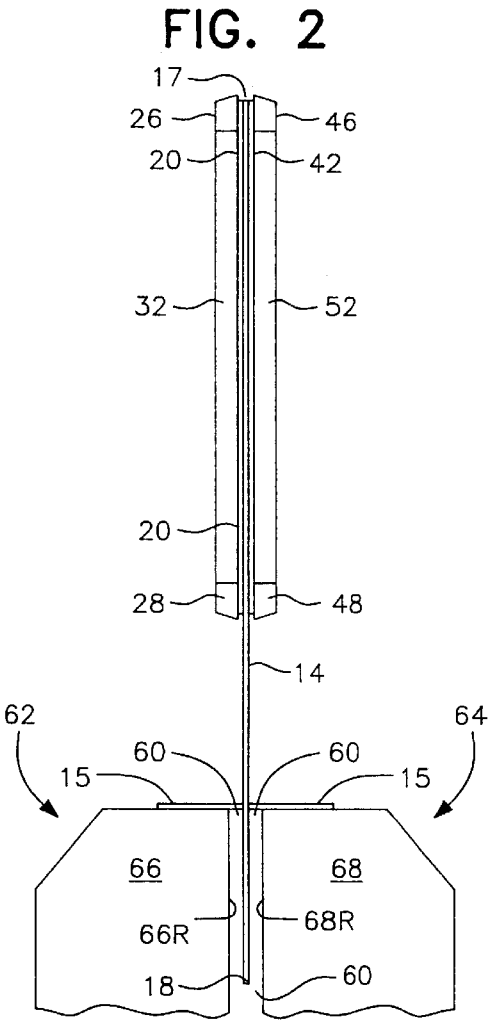
FIG. 2 is a right side elevation of the preferred embodiment of the invention.

Achievement of the foregoing objects of the present invention is enabled by the preferred embodiment which is generally designated 10 and which includes a first or left vertical leg 12 and a second or right vertical leg 14, both of which are identical to each other and are formed of vertical steel or other metal plate material. The first vertical leg 12 has a lower end 16 and the second vertical leg 14 similarly has a lower end 18. The first vertical leg 12 has two horizontally aligned transverse stop plates 13 extending from it in opposite directions (only one stop plate is shown in the drawings).

Figure 1:
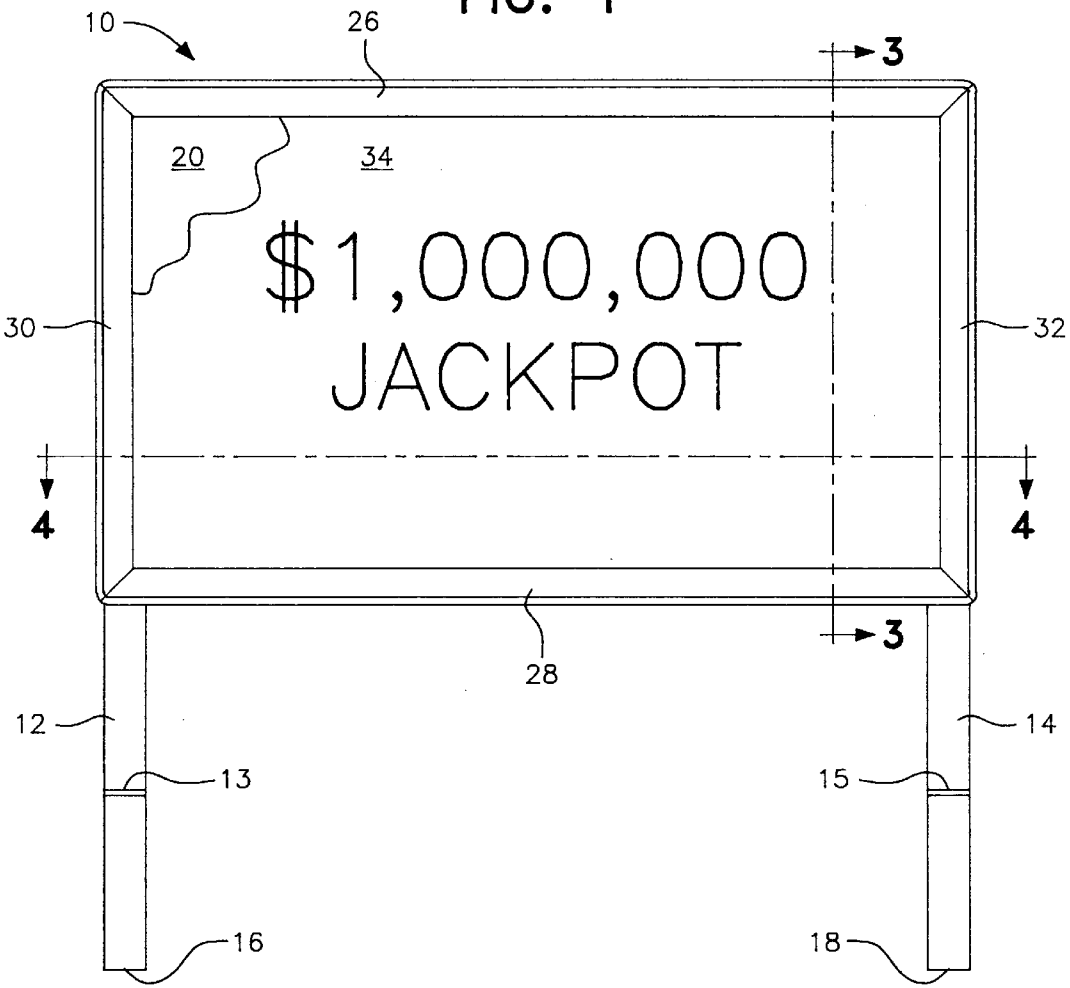
FIG. 1 is a front elevation of the preferred embodiment of the invention.

The second vertical leg 14 is identical to first vertical leg 12 and has two transverse stop plates 15 which extend outwardly perpendicular to vertical leg 14 and also has an upper end 17 as shown in FIG. 2. The first vertical leg similarly has an upper end, which is not shown. First vertical leg 12 is identical to second vertical leg 14 and the end elevation view taken from the left side of the device of FIG. 1 would be structurally identical to FIG. 2. It should also be noted that a rear elevation view of the preferred embodiment would be identical to the front elevation view of FIG. 1 with the exception of the fact that the position of vertical legs 12 and 14 would be reversed.

Figure 3:
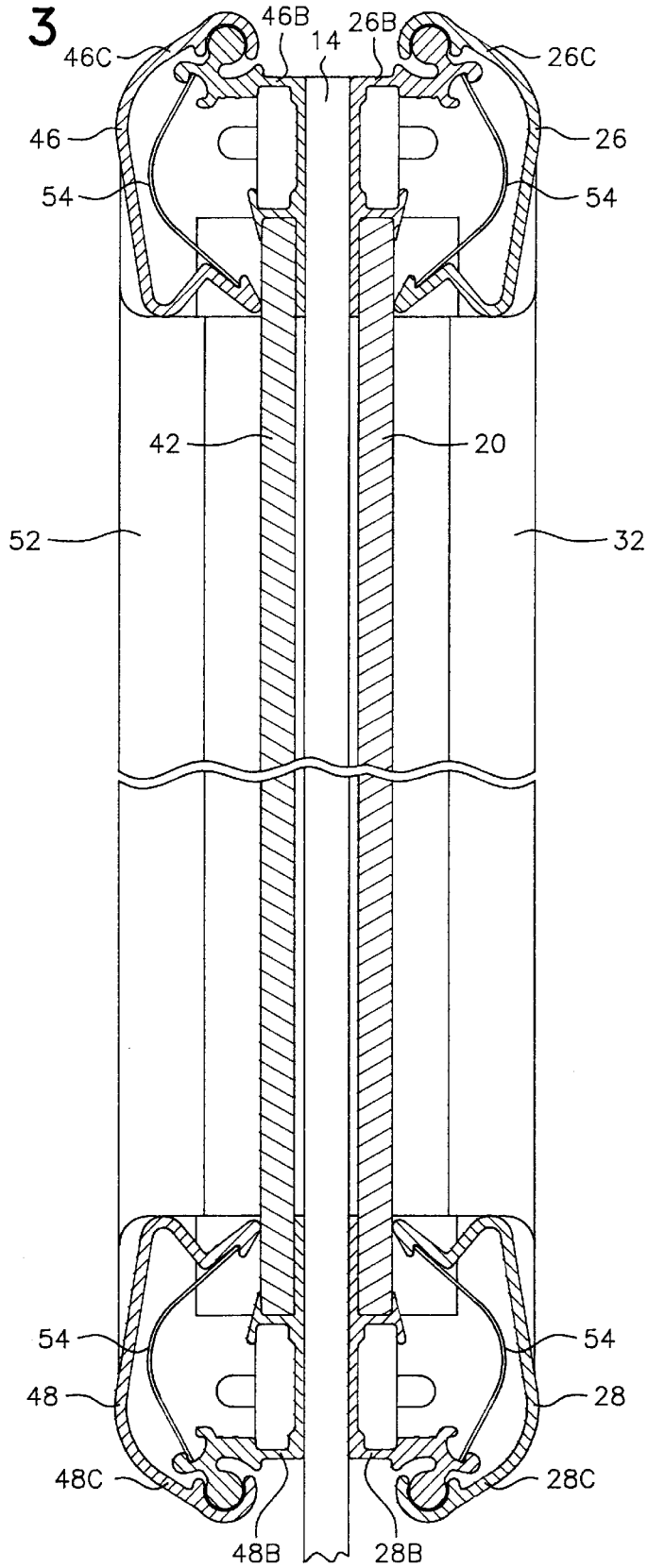
FIG. 3 is a sectional view taken along line 3—3 of FIG. 1.
Figure 4:
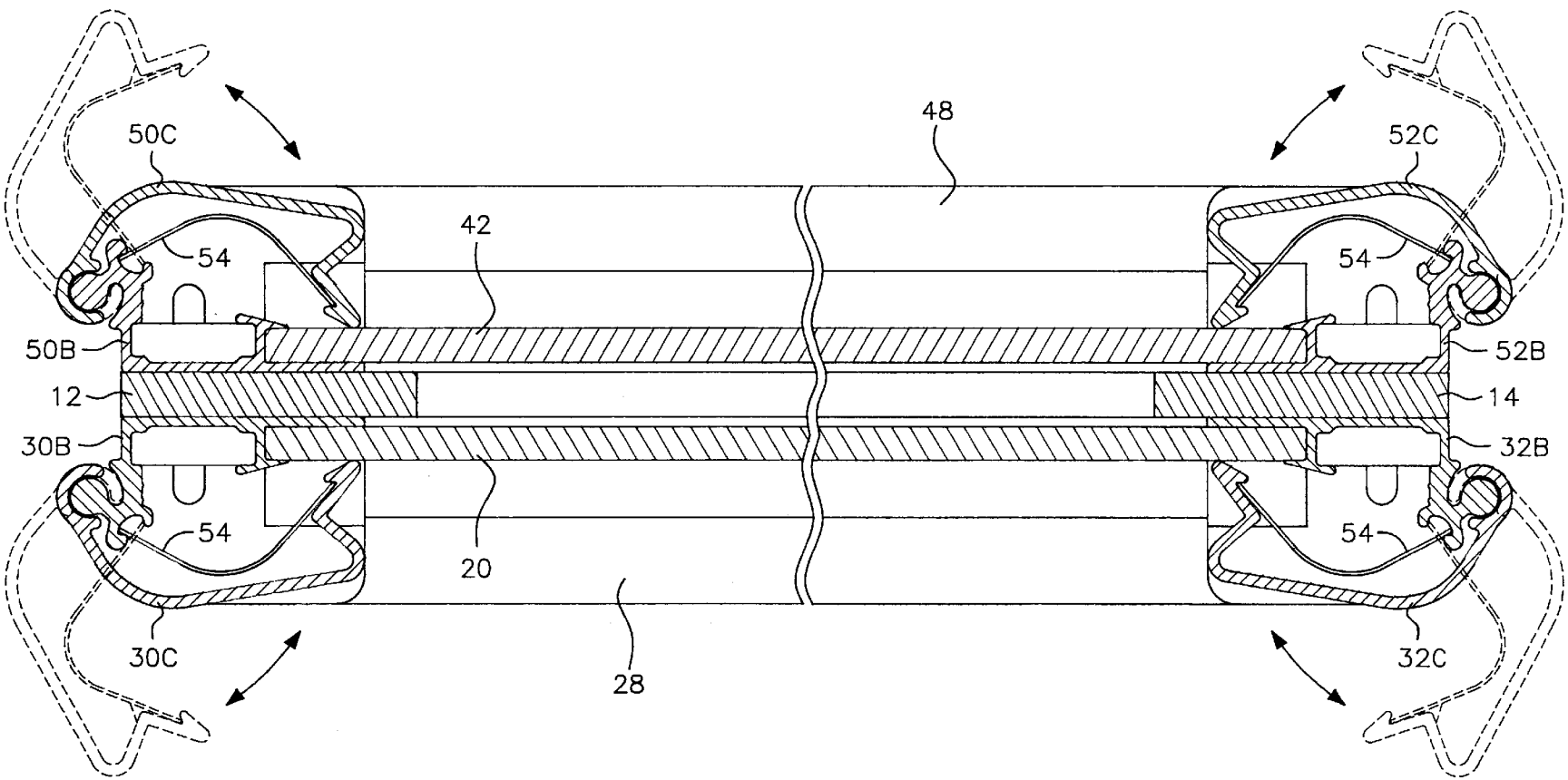
FIG. 4 is a sectional view taken along line 4—4 of FIG. 1.

A front sheet display support panel 20 formed of fiber board or the like is supported in a rectangular front border frame which is attached to the front surfaces of the first vertical leg 12 and the second vertical leg 14 and has an upper edge approximately coextensive with the upper end 17 (FIG. 2) of vertical leg 14 and the corresponding upper end of leg 12. The front border frame comprises a horizontal upper clamp frame assembly 26, a horizontal lower clamp frame assembly 28, a left vertical clamp frame assembly 30 and a right vertical clamp frame assembly 32 which enables retention of a front display sheet 34 on display support panel 20. The display sheet is formed of paper, cardboard, metal, plastic or the like and provides a desired visual message. Sheet 34 has been omitted from. FIGS. 3 and 4 for purposes of clarity.

Similarly, a rear sheet display support panel 42 (FIG. 2) formed of fiber board or the like is horizontally aligned with the front sheet display support panel 22 and is supported in a rectangular rear border frame which is identical to the front border frame and is attached to the rear surfaces of the upper portions of the vertical legs 12 and 14. The rear border frame comprises a rear upper horizontal clamp frame assembly 46, a rear lower horizontal clap frame assembly 48 (FIG. 3), a left rear vertical clamp frame assembly 50, and a right rear vertical clamp fame assembly 52 (FIG. 4). The aforementioned rear clamp frame assembly components are identical to the clamp frame components 26, 28, 30 and 32 and enable mounting of a rear display sheet in the same manner as front display sheet 34.

It should be understood that the clamp frame components 26, 28, 30, 32,42, 46, 48, 50 and 52 are conventional extruded metal which respectively each have base members 26B, 28B, 30B, 32B, 42B, 46B, 48B, 50B and 52B which receive and retain one edge of one of the support panels 20 or 42. The base members pivotally support sheet clamps 26C, 28C, 30C, 32C, 42C, 46C, 50C and 52C. The front base members 26B, 28B, 30B and 3213 are attached to the front surfaces of vertical legs 12 and 14 and the rear base members 4613, 48)3 50B and 52B are attached to the rear surfaces of vertical legs 12 and 14. Each of the sheet clamp components 26C, 28C, etc. is biased by an over-center spring 54 into either a clamping position shown in solid lines or an open position shown on dashed lines in FIG. 4. Each spring 54 urges its respective sheet clamp 26C, 28C, etc. to either position when manually moved past an over-center position. The foregoing clamp frame components are indicated by the manufacturer as being covered by one or more of U.S. Pat. Nos. 4,145,828; 4,512.095; 4,519,152; 4,523,400; 4,714,220; 4,937,959 and 4,958,458.

In use, the preferred embodiment of the invention is positioned so that the lower ends of the vertical legs 12 and 14 extend downwardly into an open or valley space 60 (FIG. 2) between back-to-back parallel rows 62 and 64 of vending or slot machines 66 and 68 which respectively have rear surfaces 66R and 68R. The downwardly facing surfaces of the transverse stop plates 13 and 15 are positioned above the bottom ends of vertical legs 12 and 14 a distance which exceeds the width of valley space 60 and rest on the upper surfaces of the rows of devices 66 and 68 to provide support for the display assembly with the lower end portions extending downwardly into the valley providing transverse stability so that the display assembly cannot fall over or create a hazard for persons in the vicinity.

Figure 5:
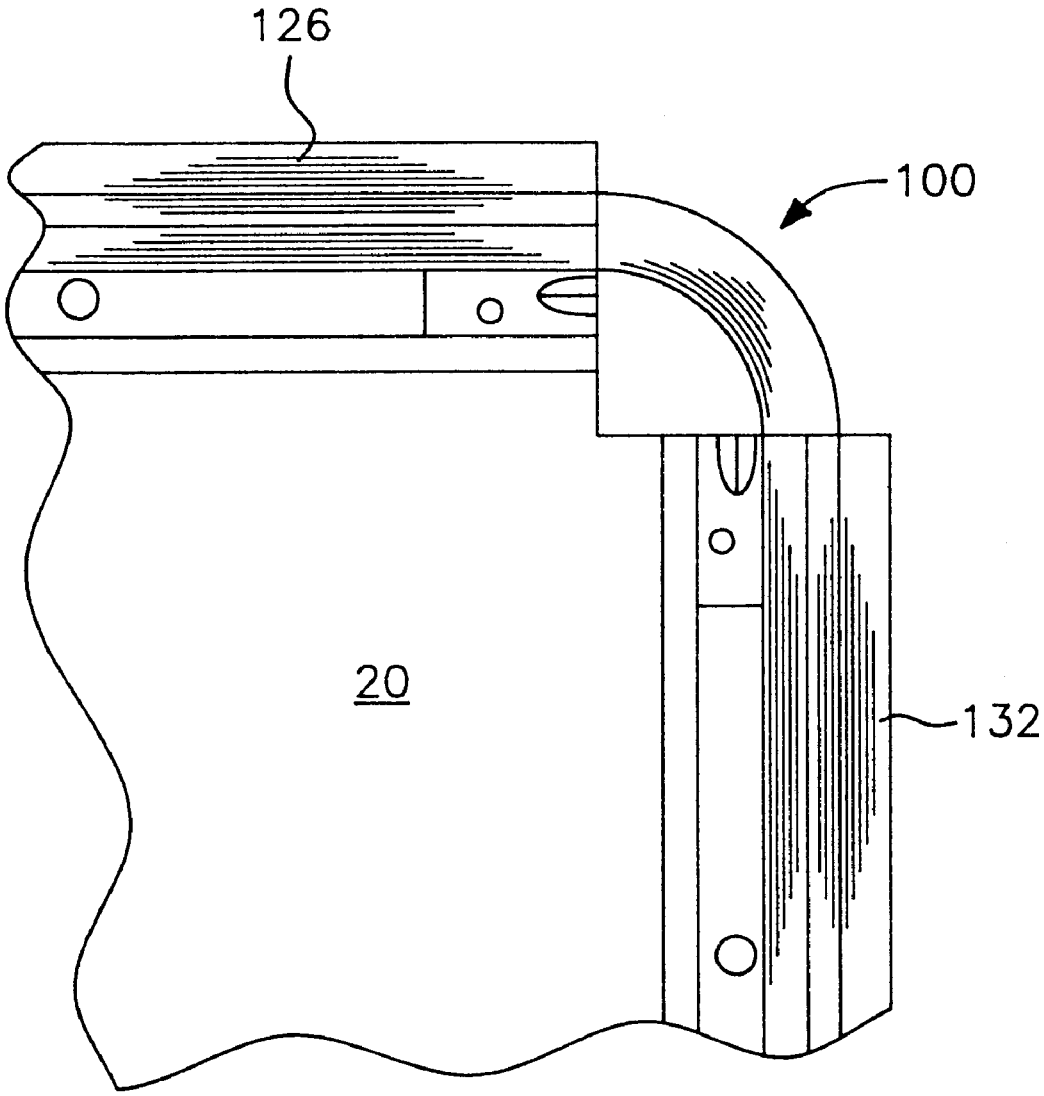
FIG. 5 is a front elevation of an alternative rounded corner embodiment of the invention.

FIG. 5 illustrates an alternative arrangement comprising a rounded corner assembly, which can be used on all four corners instead of the square corner arrangement of the embodiment of FIGS. 1 through 4. Only one such corner 100 is illustrated; however, it should be understood that the other corners would be identical in construction. The modified construction necessarily includes pivotal clamp members 126 and 132, which are reduced in length as compared to the corresponding clamp members 26 and 32 of the first embodiment. While not shown, the modified embodiment would also use reduced length clamp members in place of clamps 28 and 30 of the first embodiment.

Figure 6:
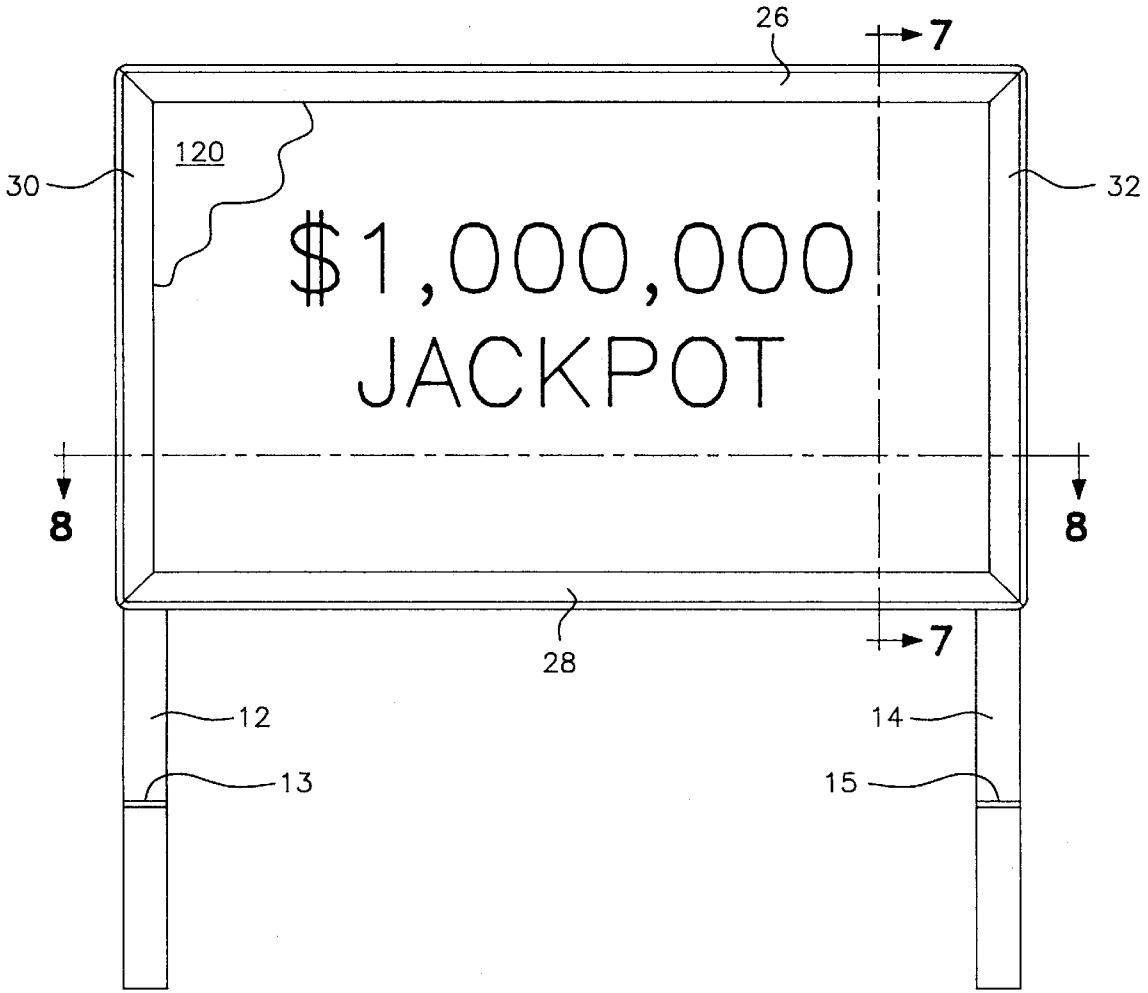
FIG. 6 is a front elevation of a back-lit embodiment of the invention.
Figure 7:
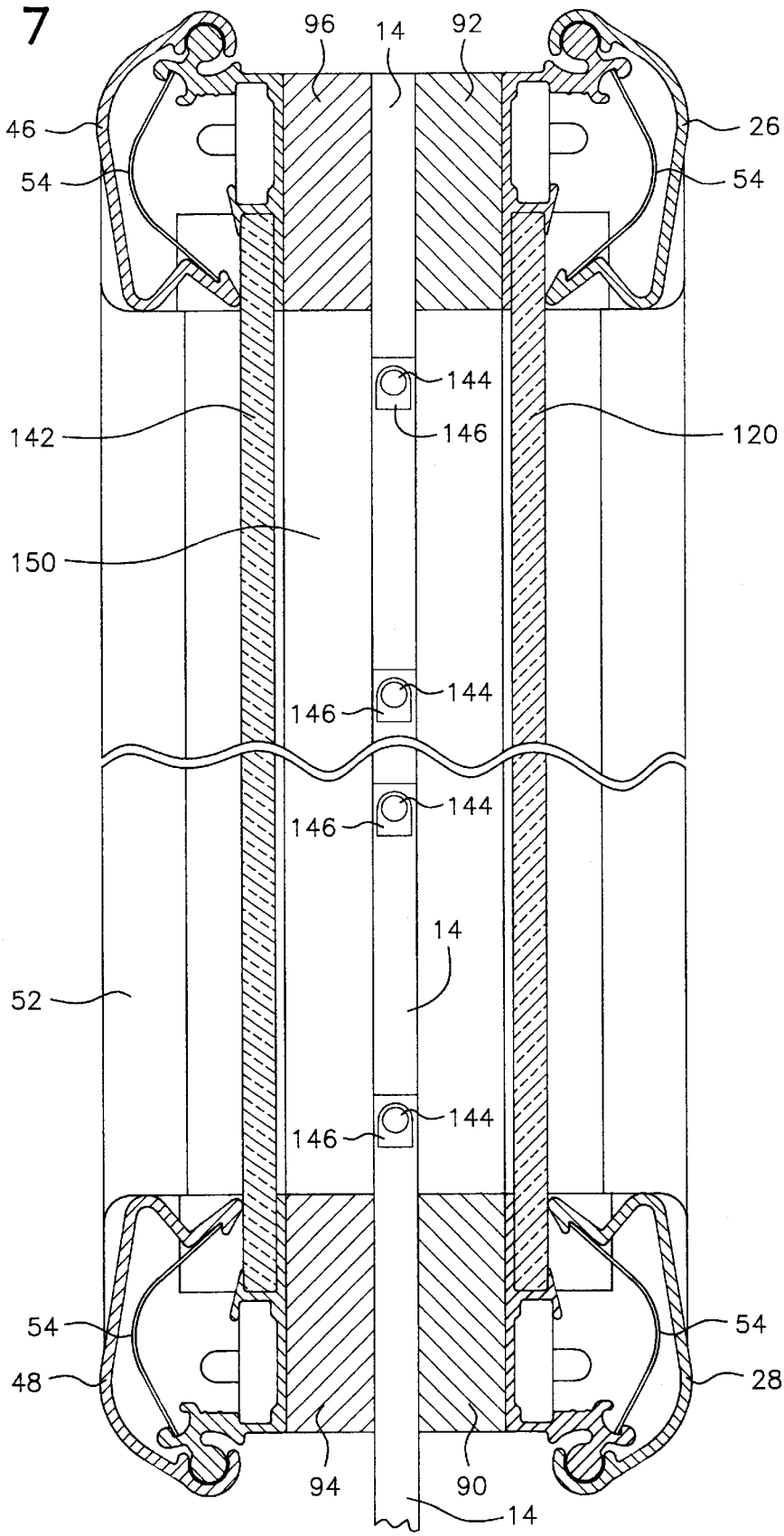
FIG. 7 is a sectional view taken along line 7—7 of FIG. 6.
Figure 8:
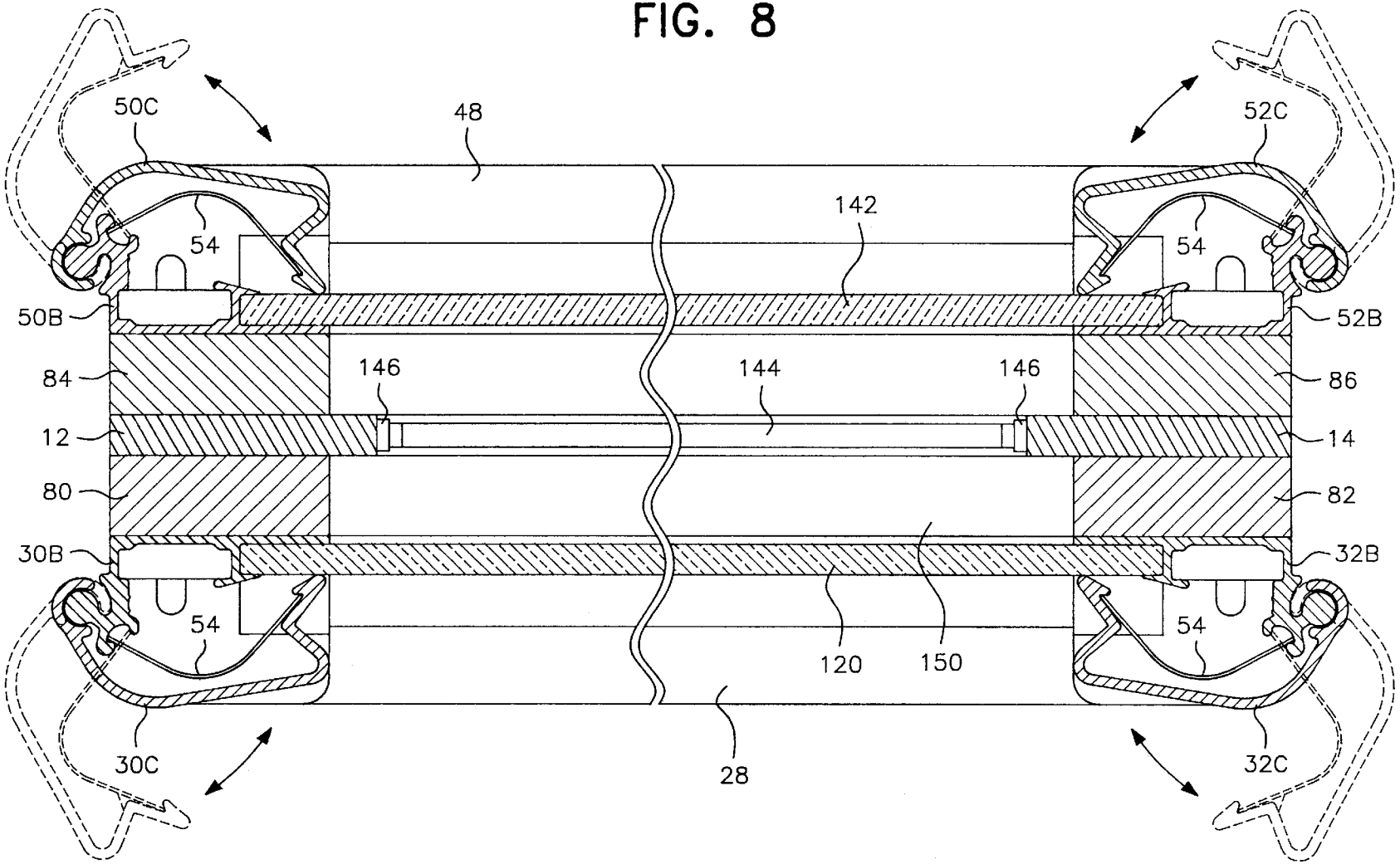
FIG. 8 is a sectional view taken along line 8—8 of FIG. 6.

FIGS. 6, 7 and 8 illustrate an alternative back-lit embodiment, which is identical to the embodiment of FIGS. 1 through 4 with the exception of the fact that the back-lit embodiment employs a front translucent plastic display support panel 120 in place of support panel 20 of the first embodiment and a rear translucent plastic display support panel 142 (FIG. 7) in place of rear support panel 42 of the first embodiment. Additionally, a plurality of fluorescent light tubes 144 are positioned internally of the space between the translucent plastic display support panels 120 and 142 as shown in FIGS. 7 and 8. Each of the fluorescent light tubes 144 is supported at each end by a conventional fitting 146 mounted on the inwardly facing surfaces of legs 12 and 14 in the manner illustrated in FIG. 8. Electrical current is supplied to the fluorescent tubes in a conventional manner. It should be understood that the use of fluorescent tubes is not mandatory for practice of the invention since other conventional light sources could also be used if desired.

The back-lit embodiment of FIGS. 6, 7 and 8 also differs from the first embodiment by the inclusion of front vertical spacer plates 80 and 82 attached to the front surfaces of legs 10 and 12 and rear vertical spacer plates 84 and 86 which are attached to the rear faced surfaces of legs 12 and 14 as shown in FIG. 8. Similarly, front horizontal spacer plates 90 and 92 extend between the front surfaces of each of the vertical legs 12 and 14 as shown in FIG. 7 and identical rear horizontal spacer plates 94 and 96 extend between legs 12 and 14 and are connected to the rear surfaces of legs 12 and 14. The spacer plates separate the front and rear clamp assemblies sufficiently to provide a space 150 of sufficient front to rear dimension between the translucent plastic display support panels 120 and 142 to easily receive the fluorescent tubes 144 as shown in FIGS. 7 and 8.

It should be understood that various other modifications of the preferred embodiment will undoubtedly occur to those of skill in the art and the spirit and scope of the invention is to be limited solely by the appended claims.

What is claimed is:

1. The combination of a visual display mounting assembly and two back-to-back rows of vending type devices separated by a valley space of a given width between the devices, the display comprising first and second vertically extending legs each having an upper end and a lower end, transverse stop plates extending transversely from the first leg at a location spaced above the lower end of the first leg, second transverse stop plates extending transversely from the second leg at a location spaced above the lower end of the second leg, the first and second transverse stop plates respectively having a combined length exceeding the width of the valley space, visual displays attached to and extending between the upper ends of the first and second legs, whereby the transverse stop plates extend across the valley space between back-to-back devices to provide vertical support for the display mounting assembly while the lower ends of the first and second vertically extending legs extend downwardly between vending devices to provide transverse stability for the display mounting assembly.

2. The display assembly of claim 1, wherein the first and second vertical legs each comprise a plate having a thickness substantially less than the width of the valley space and wherein the first and second transverse stop plates extend respectively perpendicularly from the first and second vertical legs.

3. A visual display mounting assembly positionable between and above back-to-back supporting devices separated by a valley space of a given width between the devices, the display comprising first and second legs having a vertical component of orientation and each having an upper end and a lower end, horizontally aligned transverse stop plates extending transversely from the first leg at a location spaced above the lower end of the first leg and having a total length exceeding the width of the valley space, visual display supports attached to and extending between the upper ends of the first and second legs, whereby the horizontally aligned transverse stop plates being so dimensioned as to bridge the valley space and rest upon back-to-back devices to provide vertical support for the display mounting assembly while the lower ends of the first and second legs extend between back-to-back devices bridged by the transverse stop plates to provide transverse stability for the display mounting assembly.

4. The display assembly of claim 3 wherein the first and second legs are each a metal plate having a thickness substantially less than the width of the valley space.

5. The assembly of claim 4 wherein the horizontally aligned transverse stop plates extend in a horizontal direction from the first and second legs.

6. A visual display mounting assembly positionable between and above back-to-back vending devices separated by a valley space of a given width between the vending devices, the visual display mounting assembly comprising first and second vertical legs each of which is a metal plate having a thickness substantially less than the width of the valley space and each having an upper end and a lower end, a first transverse stop plate extending transversely from the first vertical leg at a location spaced above the lower end of the first vertical leg and having a length exceeding the width of the valley space, a second transverse stop plate extending transversely from the second vertical leg at a location spaced above the lower end of the second vertical leg and wherein the first and second transverse stop plates extend respectively perpendicularly from the first and second vertical legs, the first and second transverse stop plates each comprising a front plate extending from one side of its respective vertical leg and a rear plate extending in opposite direction from the other side of its respective vertical leg, the front and rear plates being horizontally aligned with each other, visual display supports attached to and extending between the upper ends of the first and second vertical legs, and wherein the visual display supports include panels and border frames enclosing the panels and the border frames are of quadrilateral configuration and include pivotal clamp components which are openable to permit insertion of a sheet display on the panels and closeable by a spring-over-center clamp to snap into clamping relation to the sheet display to retain the sheet display in position on the panels, whereby the first and second transverse stop plates are so dimensioned as to be able to bridge the valley space between back-to-back vending devices to provide vertical support for the display mounting assembly while the lower ends of the first and second vertical legs are able to extend between vending devices bridged by the first and second transverse stop plates to provide transverse stability for the display mounting assembly.

7. A visual display mounting assembly positionable between and above back-to-back vending devices separated by a valley space of a given width between the vending devices, the visual display mounting assembly comprising first and second vertical legs each of which is a metal plate having a thickness substantially less than the width of the valley space and each having an upper end and a lower end, a first transverse stop plate extending transversely from the first vertical leg at a location spaced above the lower end of the first vertical leg and having a length exceeding the width of the valley space, a second transverse stop plate extending transversely from the second vertical leg at a location spaced above the lower end of the second vertical leg and wherein the first and second transverse stop plates extend respectively perpendicularly from the first and second vertical legs, the first and second transverse stop plates each comprising a front plate extending from one side of its respective vertical leg, the front and rear plates being horizontally aligned with each other, visual display supports attached to and extending between the upper ends of the first and second vertical legs, and wherein the visual display supports include panels and border frames enclosing the panels, whereby the first and second transverse stop plates are so dimensioned as to be able to bridge the valley space between back-to-back vending devices to provide vertical support for the display mounting assembly while the lower ends of the first and second vertical legs are able to extend between vending devices bridged by the first and second transverse stop plates to provide transverse stability for the display mounting assembly and the panels comprise a front panel attached to a first surface of each of the vertical legs and a rear panel attached to a second surface of each of the vertical legs, and wherein the front and rear panels are horizontally aligned with each other and the border frames comprise a front border frame associated with the front panel and a rear border frame associated with the rear panel, and wherein the front border frame and the rear border frame are of quadrilateral configuration and include pivotal clamp frame components which are movable to an open position to permit insertion of a sheet display on its associated panel and closeable by a spring-over-center clamp to snap into clamping relation with the sheet display to retain the sheet display on the respective panels.

8. A visual display mounting assembly positionable between and above back-to-back vending devices separated by a valley space of a given width between the vending devices, the visual display mounting assembly comprising first and second vertical legs each of which is a metal plate having a thickness substantially less than the width of the valley space and each having an upper end and a lower end, a first transverse stop plate extending transversely from the first vertical leg at a location spaced above the lower end of the first vertical leg and having a length exceeding the width of the valley space, a second transverse stop plate extending transversely from the second vertical leg at a location spaced above the lower end of the second vertical leg and wherein the first and second transverse stop plates extend respectively perpendicularly from the first and second vertical legs, the first and second transverse stop plates each comprising a front plate extending from one side of its respective vertical leg and a rear plate extending in opposite direction from the other side of its respective vertical leg, the front and rear plates being horizontally aligned with each other, visual display supports attached to and extending between the upper ends of the first and second vertical legs, and wherein the visual display supports include panel and border frames enclosing the panels, whereby the first and second transverse stop plates are so dimensioned as to be able to bridge the valley space between back-to-back vending devices to provide vertical support for the display mounting assembly while the lower ends of the first and second vertical legs are able to extend between vending devices bridged by the first and second transverse stop plates to provide transverse stability for the display mounting assembly and wherein the border frames include a pivotal spring-urged clamp for clamping a visual display sheet to the panels.

9. A visual display mounting assembly positionable between and above back-to-back vending devices separated by a valley space of a given width between the vending devices, the visual display mounting assembly comprising first and second vertical legs each having an upper end and a lower end, a first transverse stop plate extending transversely from the first vertical leg at a location spaced above the lower end of the first vertical leg and having a length exceeding the width of the valley space, a second transverse stop plate extending transversely from the second vertical leg at a location spaced above the lower end of the second vertical leg, visual display supports attached to and extending between the upper ends of the first and second vertical legs, and whereby the first and second transverse stop plates are so dimensioned as to be able to bridge the valley space between back-to-back vending devices to provide vertical support for the display mounting assembly while the lower ends of the first and second vertical legs are able to extend between vending devices bridged by the first and second transverse stop plates to provide transverse stability for the display mounting assembly and wherein the visual display supports comprise first and second translucent panels which are spaced apart and parallel to each other and additionally including light sources positioned between the first and second translucent panels.

10. The display assembly of claim 9, wherein the first and second vertical legs are each a metal plate having a thickness substantially less than the width of the valley space.

11. The assembly of claim 10, wherein the first and second transverse stop plates extend respectively perpendicularly from the first and second vertical legs.

12. The assembly of claim 11, wherein the first and second transverse stop plates each comprise a front plate extending from one side of its respective vertical leg and a rear plate extending in opposite direction from the other side of its respective vertical leg, the front and rear plates being horizontally aligned with each other.

13. The assembly of claim 12, wherein the panel displays additionally include border frames enclosing the translucent panels.

14. The assembly as recited in claim 13, wherein the border frames are of quadrilateral configuration and include pivotal clamp components which are openable to permit insertion of a sheet display on the panels and closeable by a spring-over-center clamp to snap into clamping relation to the sheet display to retain the sheet display in position on the panels.

* * * * *